US009458667B2

(12) United States Patent
Bugh

(10) Patent No.: US 9,458,667 B2
(45) Date of Patent: Oct. 4, 2016

(54) GATE FOR COMPOSITE RAILING

(76) Inventor: Roger E. Bugh, North Canton, OH (US)

( * ) Notice: Subject to any disclaimer, the term of this patent is extended or adjusted under 35 U.S.C. 154(b) by 0 days.

(21) Appl. No.: 13/401,504

(22) Filed: Feb. 21, 2012

(65) Prior Publication Data

US 2012/0217460 A1 Aug. 30, 2012

Related U.S. Application Data

(60) Provisional application No. 61/444,725, filed on Feb. 19, 2011.

(51) Int. Cl.
*E06B 11/02* (2006.01)
*E06B 3/70* (2006.01)

(52) U.S. Cl.
CPC ..... *E06B 11/02* (2013.01); *E06B 2003/7098* (2013.01)

(58) Field of Classification Search
CPC ..... E04H 17/1421; E04H 2017/1452; E04H 2017/1491; E06B 11/02; E04F 11/181; E04F 11/1817
USPC ..... 256/73, 65.07, 65.08
See application file for complete search history.

(56) References Cited

U.S. PATENT DOCUMENTS 3,756,567 A * 9/1973 Murdock ..... 256/21
5,494,261 A * 2/1996 Gandara ..... 256/24
5,716,041 A * 2/1998 Groves ..... 256/73
6,039,307 A * 3/2000 De Zen ..... 256/19
6,061,991 A * 5/2000 Dahl ..... 52/832
6,702,259 B2 * 3/2004 Pratt ..... 256/65.03
6,874,766 B2 * 4/2005 Curatolo ..... 256/59
6,938,882 B2 * 9/2005 Hadfield et al. ..... 256/73
7,090,202 B1 * 8/2006 O'Brien ..... 256/67
7,168,688 B2 * 1/2007 Davenport ..... 256/24
7,543,802 B2 * 6/2009 Petta et al. ..... 256/65.08
8,167,275 B1 * 5/2012 Bizzarri et al. ..... 256/65.08
2009/0134378 A1 * 5/2009 Petta et al. ..... 256/67

OTHER PUBLICATIONS

Azek, Gate Installation Guidelines, copyright 2011, printed from website on Apr. 4, 2012.

* cited by examiner

*Primary Examiner* — Jonathan Masinick
(74) *Attorney, Agent, or Firm* — Zollinger & Burleson Ltd.

(57) ABSTRACT

A gate for a deck railing is made with composite rails that match the profile and height of the composite rails of the deck railing where the gate is being used. The gate includes a pair of spaced side rails that securely support mounts that fit within the ends of the top and bottom composite rails. In some configurations, a cross brace is used from the top of the side rail with the hinges to the bottom of the other side rail. The gate is assembled from a gate kit that allows the user to provide lengths of the composite deck railings to be used as the top and bottom rails in the gate at locations that match the deck railing in order to provide a strong, durable deck gate that blends in with the deck railing.

20 Claims, 8 Drawing Sheets

GATE FOR COMPOSITE RAILING

CROSS REFERENCE TO THE RELATED APPLICATIONS

This application claims the benefit of U.S. Provisional Application Ser. No. 61/444,725 filed Feb. 19, 2011; the disclosures of which are incorporated herein by reference.

BACKGROUND OF THE DISCLOSURE

1. Technical Field

The disclosure generally relates to gates for deck railings and, more particularly, to a gates for porch or deck railings assembled from composite engineered lumber rails. Specifically, the disclosure relates to a gate that may be assembled from a gate kit and two sections of a wide variety of composite engineered lumber rails so that the assembled gate matches the deck railing.

2. Background Information

A variety of alternative lumber materials are currently available for outdoor decking. These materials include engineered lumber, vinyl lumber, and composite lumber. Wood-plastic composite materials are composite materials made of wood fiber (or similar) and one or more plastics. These alternative lumber products are particularly useful for exterior decking because they are more weather resistant than painted wood and require less maintenance throughout their lives. Other composite products use a composite inner section capped with a weather-resistant outer portion.

Most building codes require some type of safety railing to be placed about the circumference of a raised deck. One common type of safety railing includes a plurality of balusters disposed between top and bottom rails. The rails are disposed between support posts. The top and bottom rails are provided in a wide variety of different cross sections in order to give the customer different choices for the appearance of their deck railing.

The same building codes also require entrances and exits to the deck to be secured with gates; especially at the top of stairs. A gate is typically disposed between a pair of support posts and connected to one of the posts with hinges that allow the gate to open and close. Building custom gates for deck railings is relatively expensive and time consuming because the gates must be strong and durable. Deck installers usually build these gates from raw materials and have encountered difficulties in providing a strong, durable gate that has a desirable ornamental appearance. In order to increase the strength and durability of the gates, the deck installers often use materials that do not match the deck railing thus degrading the ornamental appearance of the deck railing. This frequently occurs when the deck railing is made from composite materials that are not as versatile as wood lumber or aluminum channels. Customers, and thus deck installers, desire a strong, durable deck gate that blends in with their deck by matching rail profiles and rail heights.

SUMMARY OF THE DISCLOSURE

The disclosure provides a gate kit for a deck railing made with composite rails. The gate kit allows lengths of the composite deck railings to be used in the gate at locations that match the railing to provide a strong, durable deck gate that blends in with the deck railing.

The disclosure also provides a gate formed from the gate kit of the disclosure wherein the gate includes top and bottom composite rails supported between a pair of side rails from upper and lower mounts wherein a portion of the upper mounts are received within the outer perimeter profile of the top rails. An optional cross brace is used to strengthen the gate. In one configuration, the optional cross brace is formed from two pieces that are connected together in a manner that allows the length of the cross brace to be adjusted.

The gate kit of the disclosure includes a pair of strong vertical support members or side rails that include installed upper mounts adapted to receive the upper composite rail of the gate. Hardware is provided to secure the top rail to the upper mounts. A pair of uninstalled lower mounts are provided for the lower composite rail of the gate. Self-tapping metal screws are provided for the lower mounts so that the installer can locate and install the bottom rail after the balusters are installed. Hardware is also provided to mount the bottom rail to the lower mounts. Optionally, the kit may include a cross brace and mounting hardware. The kit may be used with a variety of hinges.

The disclosure also provides a gate kit and gate having extended upper and lower mounts that eliminate the need for the cross brace.

In some configurations, the disclosure provides a gate kit used with composite rails having outer and support portions wherein the mounts that secure the rails have portions disposed between the outer and support portions.

One configuration of the disclosure provides a gate kit wherein the top rail has outer and support portions wherein the connector that secures the mount to the rail extends into the support portion and, in the top rail, extends through the support portion into the outer portion of the rail. In one configuration, the support portion has a solid central portion that receives the connector. The solid central portion has a thickness more than two times greater than the wall thickness of its legs so that it provides a strong seat for the connector.

The disclosure also provides a method for assembling a gate having composite rails using the gate kit of the disclosure.

BRIEF DESCRIPTION OF THE DRAWINGS

Similar numbers refer to similar parts throughout the specification.

DETAILED DESCRIPTION OF THE DISCLOSURE

Figure 1:
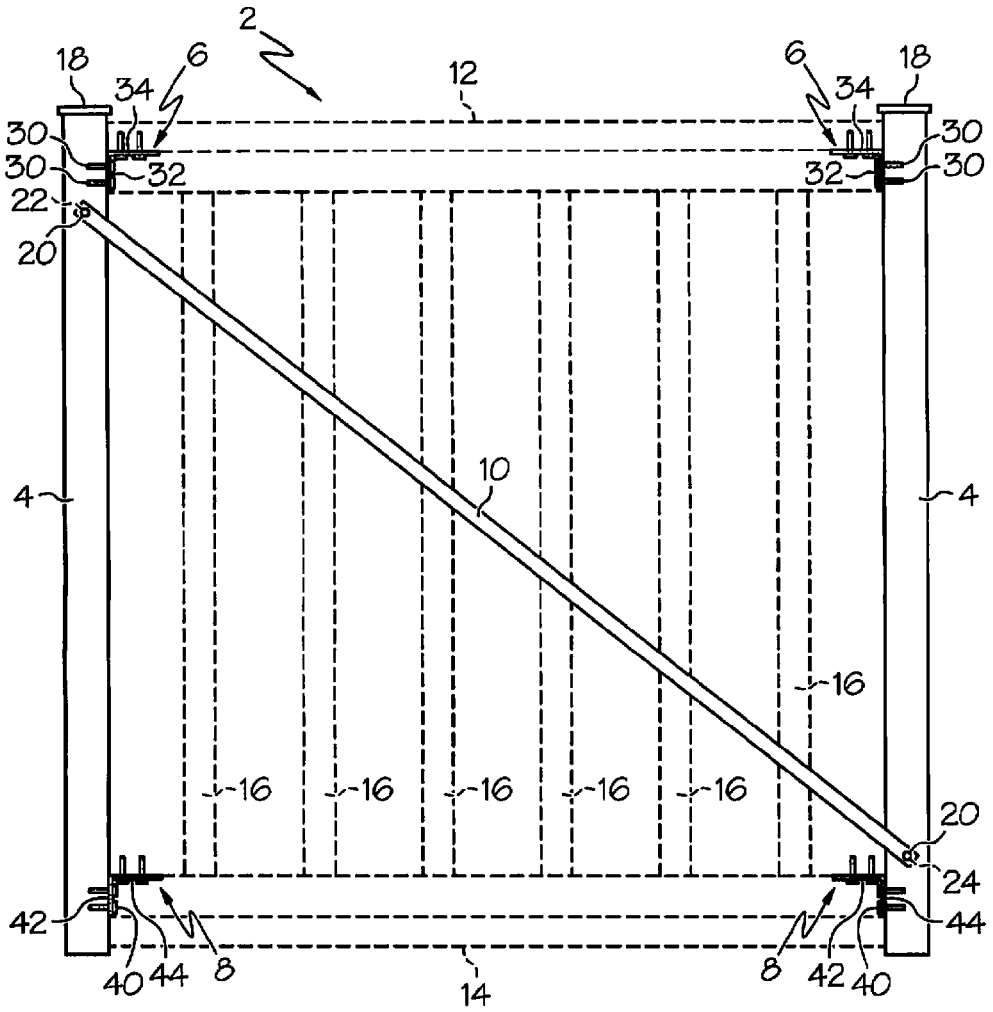
FIG. 1 is a front elevation view of the gate kit parts with the gate rails and balusters depicted in dashed lines.
Figure 2:
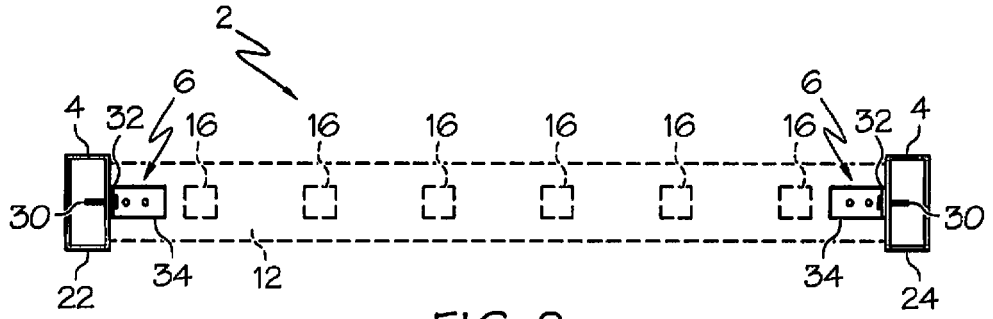
FIG. 2 is a top plan view of FIG. 1.

An exemplary configuration of a gate kit is indicated generally by the reference numeral 2 in FIGS. 1 and 2. Gate kit 2 is used to form a gate that is used to secure a gate opening of a railing system. Gate kit 2 is particularly designed for use with deck railing systems that use composite railings as the top and bottom rails. Gate kit 2 allows the user to create a gate with sections of the same top and bottom rails that are used with the deck railing sections so that the gate matches the deck railing sections as desired in the industry.

An exemplary configuration of gate kit 2 is depicted in solid lines in FIGS. 1 and 2 while the balusters and rails shown in dashed lines match the deck railing where the gate is to be installed. The rails and balusters are optionally supplied by the user or, in other configurations kit 2 may include the rails and balusters sized to fit particular openings.

Gate kit 2 generally includes a pair of side rails 4, upper mounts 6, and lower mounts 8. In some configurations, gate kit 2 also includes a cross brace 10. Gate kit 2 may optionally include the hardware used to assemble the elements of gate kit 2 into a gate. In some configurations, gate kit 2 includes top 12 and bottom 14 rails and a plurality of balusters 16 that are used to complete gate 2. In other configurations, gate kit 2 is provided without rails 12, 14 or balusters 16 with these elements being provided by the installer to match the deck railing. At least one end of each side rail 4 is provided with an end cap 18 that is formed from the same material as side rails 4.

Figure 7:
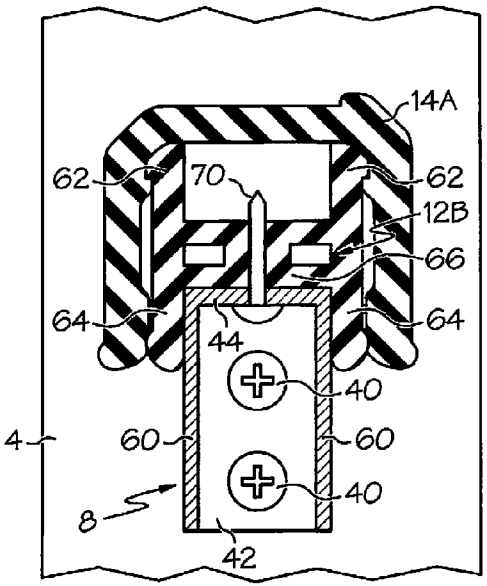
FIG. 7 is a section view showing how the bottom rail is connected to the lower mount.
Figure 6:
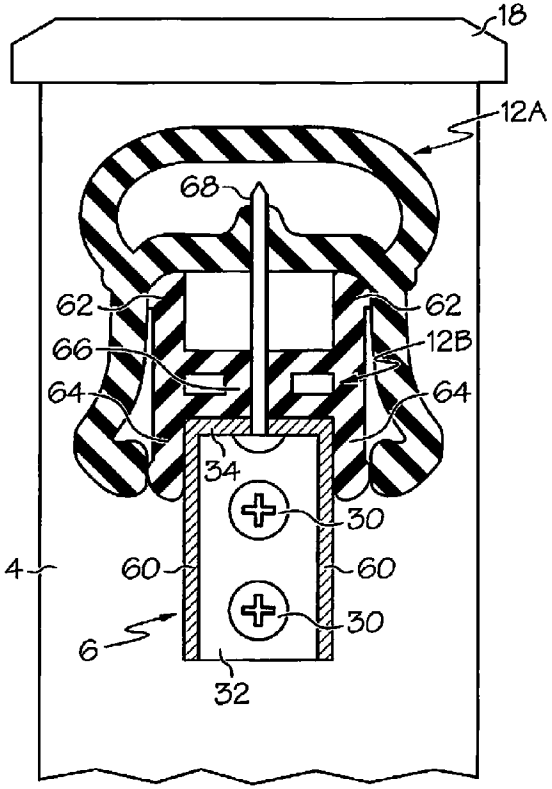
FIG. 6 is a section view showing how the top rail is connected to the upper mount.

Each side rail 4 is made from a strong, durable material such as aluminum. Each side rail 4 has a hollow rectangular cross section as shown in FIG. 2. Other strong durable materials may be used such as solid wood, hollow steel and other metals, reinforced plastics, engineering lumbers, and the like. Aluminum is preferred because of its resistance to weather, its relatively low weight, and its ability to be tapped to receive metal screws and to securely receive self-tapping metal screws. In one exemplary configuration, 1.75 inch wide by 3.50 inch deep aluminum stock is used for each side rail 4. The 3.50 inch depth is larger than most composite rails such that no portion of the composite rail overhangs the edge of a side rail when the composite rail abuts the side rail as shown in FIGS. 3 and 6-7. The wall thicknesses are 0.125 inches. A common height for the gate is 35 inches and common widths are 24 to 48 inches.

Cross brace 10 may be manufactured from the same material as side rails 4 or another of the materials listed above. Cross brace 10 may have a solid cross section. Brace 10 may be 0.25 by 0.50 inch aluminum stock.

Cross brace 10 is thin and flat with openings provided at both ends to receive self-tapping metal screws 20 that secure the brace ends to the upper and lower thirds of side rails 4. Cross brace 10 is connected near the top of side rail 4 that is connected to the hinges 21. One side rail 4 may be provided with an opening 22 (or the installer may form opening 22) configured to receive screw 20 that connects one end of cross brace 10 to side rail 4. The other end of cross brace 10 is located near the bottom of the other side rail 4 by the installer at the end of the assembly process. The installer drills opening 24 and secures brace 10 with a self-tapping screw 20.

Figure 9:
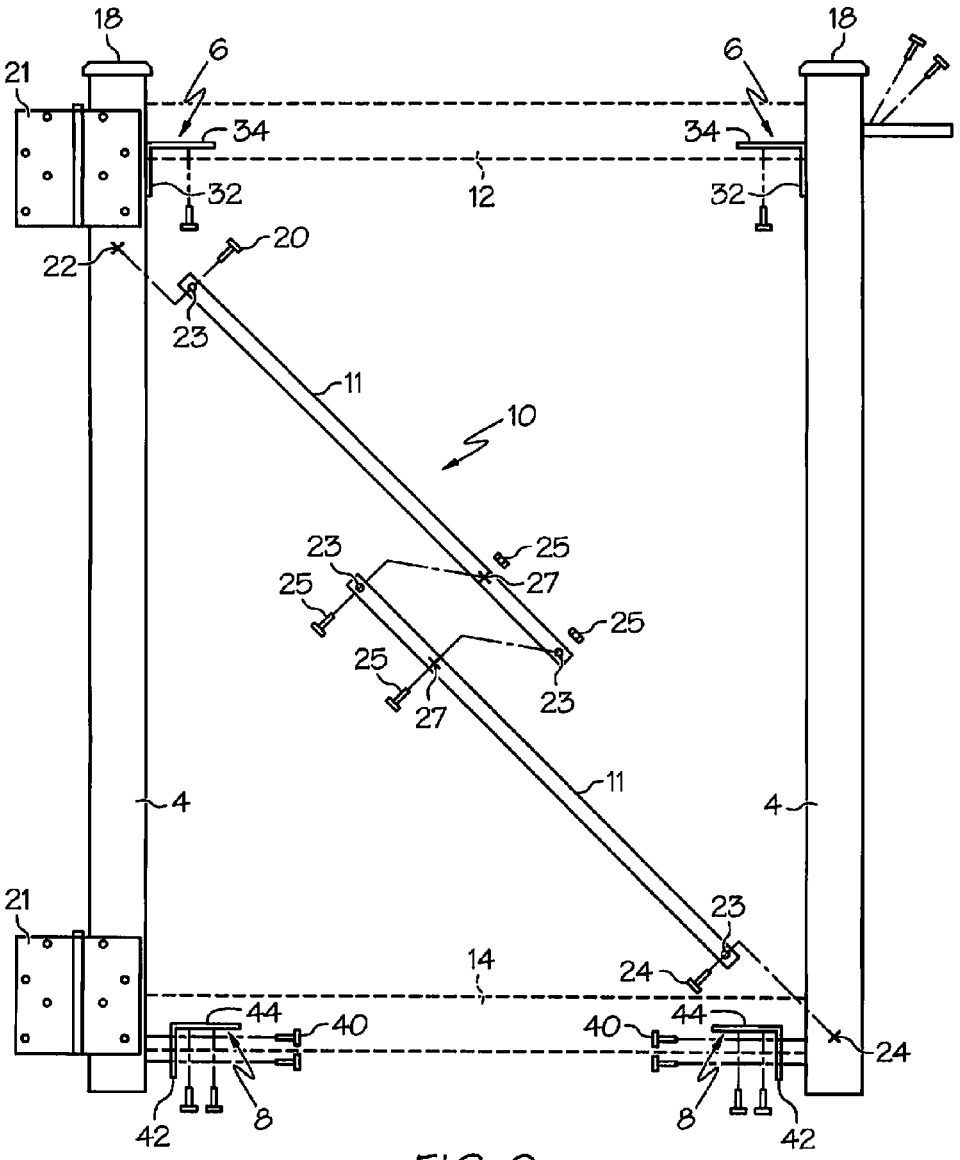
FIG. 9 is an exploded view of another configuration of the gate kit with a different cross brace.

Alternatively as shown in FIG. 9, cross brace 10 may be formed from two sections 11 of cross brace material. Each section 11 is anchored to a side rail 4 and joined together near the middle of gate 2. The use of two cross brace sections 11 allows the overall length of cross brace 10 to be adjusted so that cross brace 10 may be used with a range of gate widths. The outer surfaces of side rails 4 and cross brace 10 may be painted (such as by powder coating) to match the color of the deck railing in which gate 2 is to be installed. The inner and outer ends of sections 11 are provided with openings 23 that are configured to receive fasteners 25 such as metal screws, rivets, or nut and bolt combinations that are used to securely join the inner ends of sections 11 together. Additional openings 27 are drilled by the installer to receive these fasteners after the overall length of cross brace 10 is determined.

Figure 5:
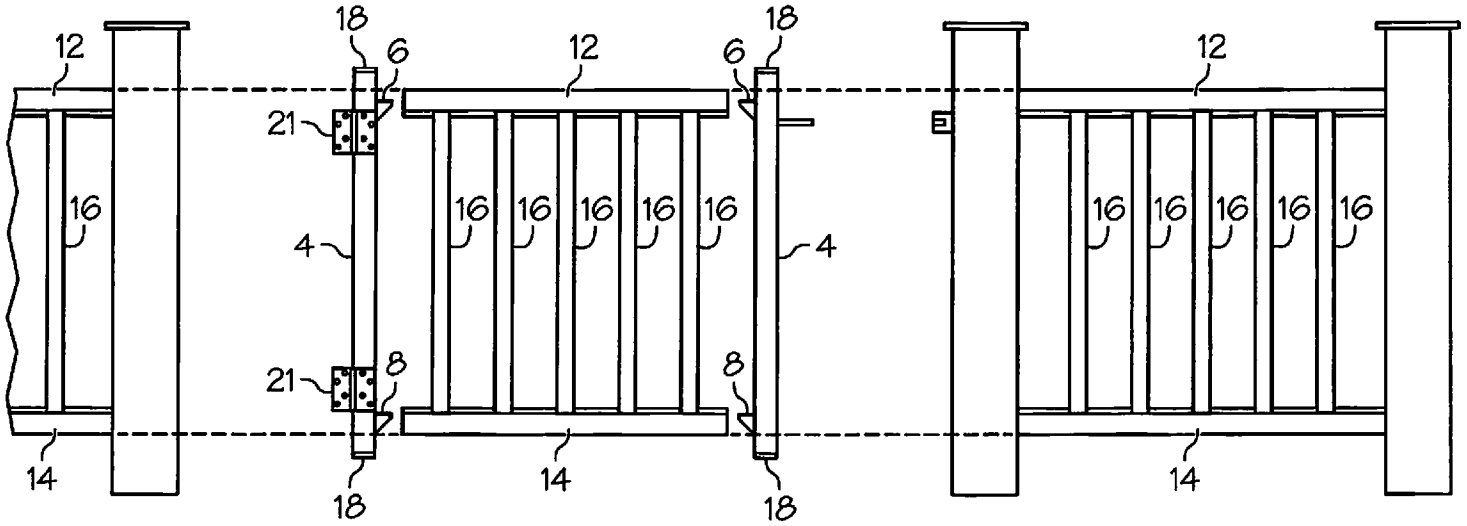
FIG. 5 is an exploded view of the gate of FIG. 4 with the rails and balusters assembled positioned between two sections of railings.

Each side rail 4 is provided with upper mount 6 secured thereto with fasteners 30 such as screws, rivets, bolts, or an appropriate weld. As shown in FIG. 2, mounts 6 are centered with respect to the depth of side rail 4. In the exemplary configuration of FIGS. 1-3, mounts 6 are two inch by two inch L-shaped aluminum brackets finished to match side rail 4. In the exemplary configuration, mounts 6 are secured to side rails 4 with a pair of spaced mechanical fasteners 30 such as metal screws. Each mount 6 has a first leg 32 secured to side rail 4 and a second leg 34 that defines a hole or a pair of spaced holes that receive fasteners used to secure rail 12 to mount 6. As shown in FIG. 5, mounts 6 are positioned on side rails 4 such that second leg 34 is spaced from the upper end of side rail 4 a distance that positions rail 12 a distance down from the upper end of side rail 4 to match the top rail location of the deck railing in which the gate is to be installed. The gate thus blends into the railing because top and bottom rails 12,14 of the gate and the railing sections are the same shape and height. In some configurations, a backing material may be provided on the inside of side rail 4 to receive screws 30 to strengthen the connection between side rail 4 and fasteners 30. Mounts 6 thus project rigidly away from side rails 4 at a location spaced down from the upper end of side rails 4. FIG. 3 shows that mounts 6 are spaced down far enough to accommodate a variety of composite rails 12 with no portion of rails 12 overlapping or overhanging the upper end of side rails 4. In one configuration of kit 2, mounts 6 are preinstalled shipped to the installer secured to side rails 4. In another configuration, mounts 6 are provided loose and side rails 4 are provided with tapped holes configured to receive fasteners 30.

Lower mounts 8 are also L-shaped aluminum brackets finished to match side rails 4. Mounts 8 are secured to side rails 4 with fastener or fasteners 40. Mounts 8 are provided separate from side rails 4 so that the installer can locate rail 14 as needed. As such, the installer drills the holes that receive screws 40 and screws 40 are self-tapping metal screws. Each mount 8 has a first leg 42 secured to side rail 4 and a second leg 44 that defines a pair of spaced holes that receive screws used to secure rail 14 to mount 8. Mounts 8 are positioned on side rails 4 such that second leg 44 is spaced from the lower end of side rail 4 a distance that positions rail 14 a distance up from the lower end of side rail 4 to match the rail location of the deck railing in which the gate is to be installed. In some configurations, a backing material may be provided on the inside of side rail 4 to receive screws 40 to strengthen the connection between side rail 4 and screws 40. Mounts 8 thus project rigidly away from side rails 4 at a location spaced up from the lower end of side rails 4. Mounts 8 are spaced up far enough to accommodate a variety of composite rails 12 with no portion of rails 12 overlapping the lower end of side rails 4.

Figure 3A:
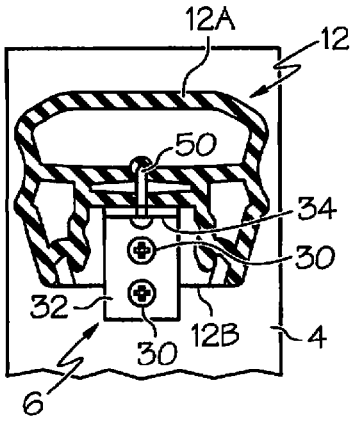
FIGS. 3A-F are cross sectional views of different composite rails connected to the upper mount of one side rail showing that each horizontal portion of the upper mount is disposed within the outer perimeter of the composite rail.
Figure 3B:
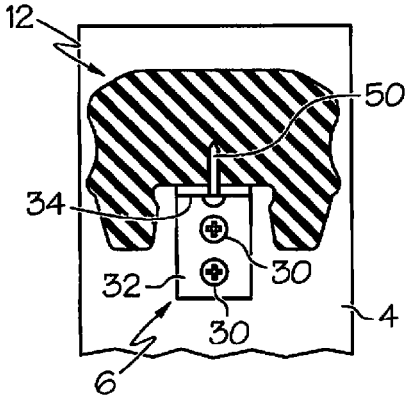
Figure 3C:
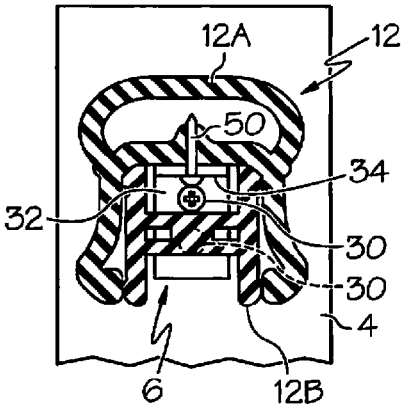
Figure 3D:
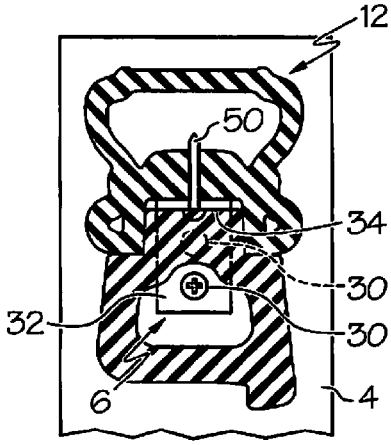
Figure 3E:
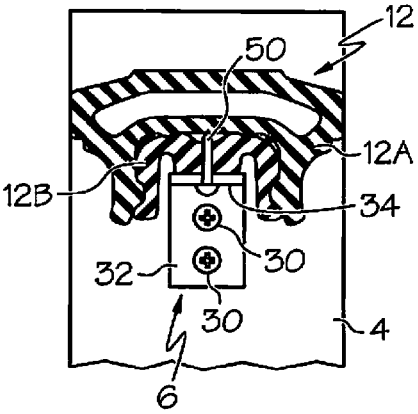
Figure 3F:
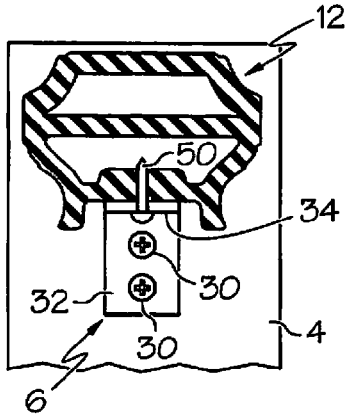
Figure 4:
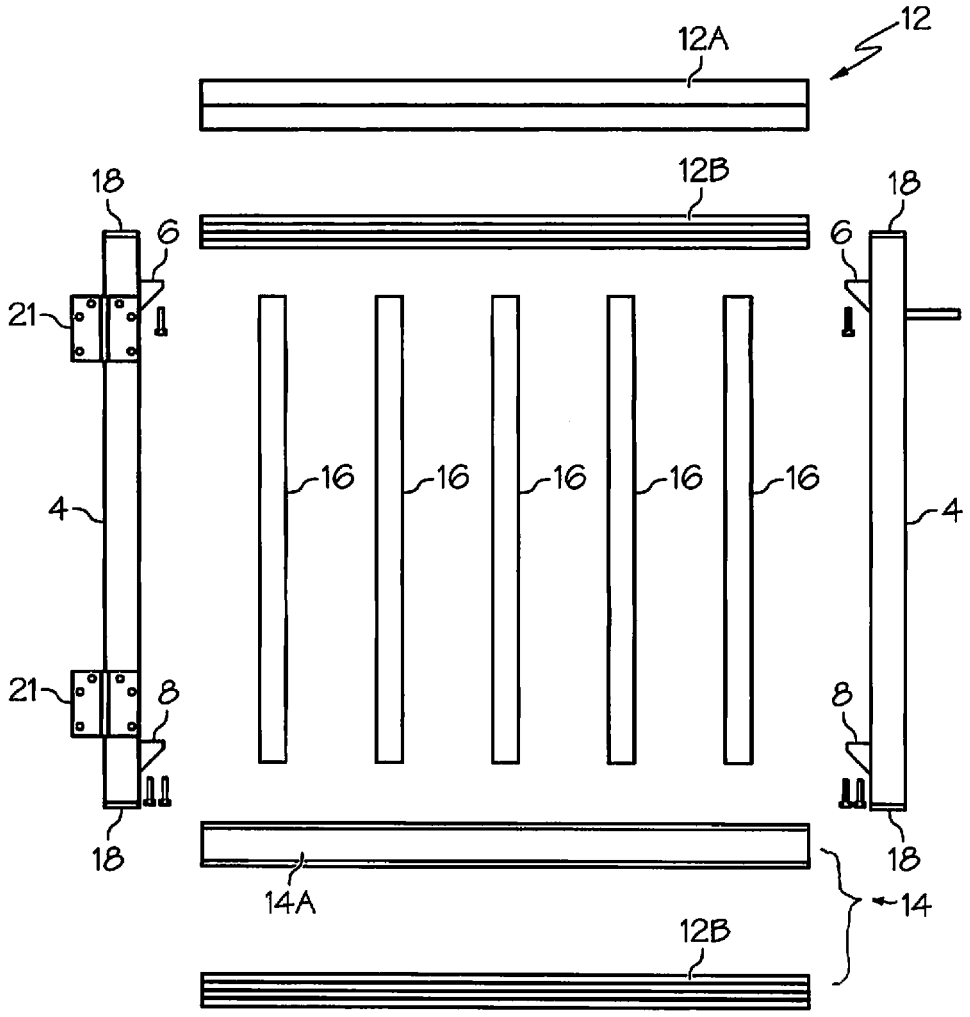
FIG. 4 is an exploded view of a gate made from another configuration of the gate kit of the disclosure.

Second leg 34 of each mount 6 is secured to a portion of top rail 12 and second leg 44 of each mount 8 is secured to a portion of bottom rail 14. Depending on the configuration of rails 12 and 14, these connections may be made after balusters 16 are installed. Different rail configurations are depicted in FIG. 3. Some of these rails have outer 12A and support 12B portions that are connected together to form rail 12. When rail 12 includes multiple portions, second leg 34 is desirably, but not always, inserted between the two portions as depicted in FIGS. 3A, 3C, and 3D. In the other configurations, second leg 34 is located under rail 12 as shown in FIGS. 3B, 3E, 3F, and 6. In all of the configurations, second leg 34 is disposed within the perimeter of at least top rail 12 so that it is not readily visible when gate 2 is in use. Second leg 34 may be secured with screws, rivets, bolts, or other fasteners 50 that achieve a secure connection with rail 12.

Figure 8A:
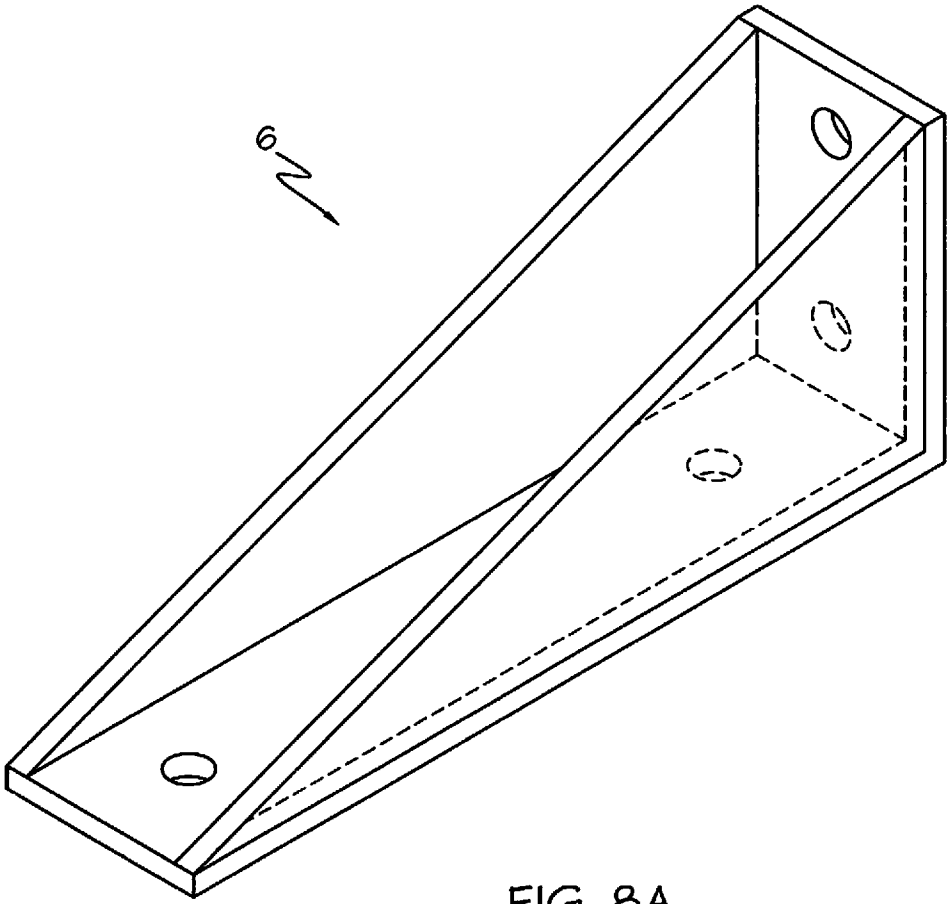
FIG. 8A is a perspective view of an alternative upper mount and FIG. 8B is a perspective view of an alternative lower mount.
Figure 8B:
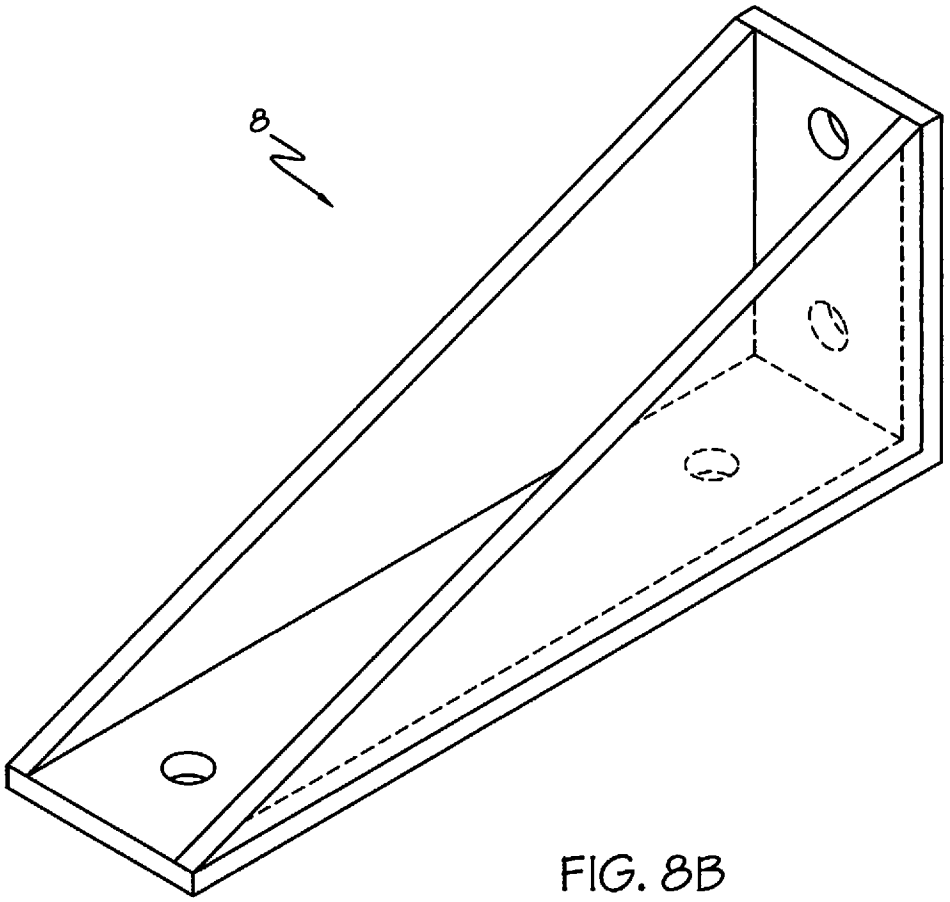

Another configuration for the gate is depicted in FIGS. 4-7 wherein cross brace 10 may be used but is optional. One feature of this configuration is that each mount 6 and 8 is provided with angled side flanges 60 that increase the rigidity of mounts 6 and 8 and help support rails 12 and 14. An alternative configuration of mounts 6, 8 is shown in FIG. 8 wherein mount 6,8 is over twice as long as its height and may be two and a half times as long as its height (5 inches compared to 2 inches in the exemplary configuration). In this configuration, composite top rail 12 is the same configuration as that shown in FIG. 3C wherein outer portion 12A is carried on an H-shaped support portion 12B that has two spaced upwardly projecting legs 62 and two spaced downwardly projecting legs 64 joined together with a central support 66 having a solid central portion disposed between channels. In this configuration, a second H-shaped support portion 12B is used with an outer bottom rail portion 14A to form bottom rail 14 as shown in FIG. 7. As noted above, second legs 34 and 44 are desirably disposed within the perimeter of rails 12 and 14 even though side flanges 60 extend down out of the bottom edges of rails 12 and 14. Because side flanges 60 are used in this configuration, mounts 6 and 8 are disposed under support portion 12B between the downwardly-projecting legs 64 of support portion 12B.

Another feature of this configuration is the manner in which mounts 6,8 are secured to rails 12 and 14. The connectors 68,70 which secure mounts 6,8 to rails 12,14 are passed into or through the solid central portion of central support 66 of support portion 12B of rails 12 and 14. The solid central portion has a thickness that is more than two times greater than the wall thickness of legs 62,64 so that it provides a strong seat for the connector 68 that secures support portion 12B to mount 6,8. In the top rail 12, the connector 68 passes entirely through support portion 12B and into outer portion 12A while the connector 70 only passes through support portion 12B in bottom rail 14 (shown in FIGS. 6 and 7).

The method of using gate kit 2 includes the steps of selecting the height and width of the gate to be formed. When the height is standard, the installer uses a kit provided with side rails 4 in the correct height. When the height is custom, the installer obtains a kit with side rails that are too long and cuts away the lower ends of side rails 4 to achieve the desired length. The installer then cuts rails 12 and 14 to the correct width and lays out balusters 16. In the FIG. 3 configurations wherein balusters 16 must be installed before support portion 12B is installed, the installer installs balusters 16 and leaves support portion 12B loose. The installer then secures outer rail portion 12A to second legs 34 with fasteners 50. The installer than connects support portion 12B to outer rail portion 12A. Bottom rail 14 is installed in the same manner except that the installer will locate bottom rail 14 and then drill the holes in side rails 4 for screws 40. Bottom rail 14 is then installed in the same manner as top rail 12. The installer then locates and installs cross brace 10. Hinges 21 and the gate latch are then attached and the gate is ready to install onto a post of the railing such that rails 12 and 14 are disposed at the same level as the rails of the railings.

In the configuration of FIGS. 6 and 7, the user first assembles the railing panel that is used to form the gate by cutting the top and bottom rails to length and assembling the balusters between the rails. The user then locates and secures the lower mounts to the side rails. The top and bottom railings are then secured to the mounts to form the gate.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the description and illustration of the invention is an example and the invention is not limited to the exact details shown or described. Throughout the description and claims of this specification the words "comprise" and "include" as well as variations of those words, such as "comprises," "includes," "comprising," and "including" are not intended to exclude additives, components, integers, or steps.

The invention claimed is:

1. A gate and a railing section comprising:

a railing section having top and bottom horizontal wood-plastic composite rails extending between vertical posts;

a gate having first and second side rails; each side rail having a width and a depth; each side rail having an inwardly-facing outer surface that defines the overall depth of the side rail and faces inwardly toward the middle of the gate;

one of the side rails being connected to one of the vertical posts of the railing section with a hinge assembly such that the gate pivots between open and closed positions with respect to the vertical post;

the gate further having top and bottom wood-plastic composite rails;

the top composite rail of the gate primarily made from a wood-plastic composite material; the top wood-plastic composite rail of the gate having an outer perimeter in cross section;

an upper mount mounted against the inwardly-facing outer surface of each side rail; each of the upper mounts having a portion disposed within the outer perimeter of the top wood-plastic composite rail of the gate;

the bottom wood-plastic composite rail primarily made from a wood-plastic composite material; the bottom wood-plastic composite rail having an outer perimeter in cross section;

a lower mount mounted against the inwardly-facing outer surface of each side rail; each of the lower mounts having a portion disposed within the outer perimeter of the bottom wood-plastic composite rail of the gate;

the top wood-plastic composite rail of the gate being aligned at the same height with the top composite rail of the railing section; and the bottom wood-plastic composite rail of the gate being aligned at the same height with the bottom composite rail of the railing section.

2. The gate and railing section of claim 1, wherein the first and second side rails are hollow aluminum and each has a rectangular cross section.

3. The gate and railing section of claim 2, further comprising an end cap carried by at least one end of each of the side rails.

4. The gate and railing section of claim 2, further comprising a cross brace extending between the first and second side rails.

5. The gate and railing section of claim 1, wherein the upper and lower mounts are L-shaped and include first and second legs.

6. The gate and railing section of claim 5, wherein each mount further includes a pair of side flanges extending between the first and second legs.

7. The gate and railing section of claim 6, wherein the first leg of each mount has a length and is connected to the inwardly-facing outer surface of the side rail; the second leg having a length that is greater than twice the length of the first leg.

8. The gate and railing section of claim 1, wherein the top wood-plastic composite rail includes a wood-plastic outer portion and a wood-plastic support portion that fit together to form the top wood-plastic composite rail.

9. The gate and railing section of claim 8, wherein the portion of the upper mount disposed within the outer perimeter of the top wood-plastic composite rail is disposed between the wood-plastic support portion and the wood-plastic outer portion.

10. The gate and railing section of claim 8, wherein the portion of the upper mount disposed within the outer perimeter of the top wood-plastic composite rail is disposed under the wood-plastic support portion of the top rail.

11. The gate and railing section of claim 10, further comprising a fastener that extends through the upper mount, the wood-plastic support portion, and into the wood-plastic outer portion.

12. The gate and railing section of claim 11, wherein the wood-plastic support portion includes a solid central portion; the fastener extending through the solid central portion.

13. The gate and railing section of claim 12, wherein the wood-plastic support portion defines downwardly-extending legs that each have a thickness; a portion of the upper mount being disposed between the downwardly-extending legs.

14. The gate and railing section of claim 13, wherein the solid central portion has a thickness greater than the thickness of one of the downwardly-extending legs.

15. The gate and railing section of claim 1, wherein the top wood-plastic composite rail of the gate has the same cross sectional size and shape as the top composite rail of the railing section and the bottom wood-plastic composite rail of the gate has the same cross sectional size and shape as the bottom composite rail of the railing section.

16. A gate and a railing section comprising:

a railing section having top and bottom horizontal wood-plastic composite rails extending between vertical posts;

a gate having first and second metal side rails each with a rectangular cross section; each side rail having a width and a depth with the depth being larger than the width; each side rail having an inwardly-facing outer surface that defines the overall depth of the side rail and faces inwardly toward the middle of the gate; one of the side rails being connected to one of the vertical posts of the railing section with a hinge assembly such that the gate pivots between open and closed positions with respect to the vertical post;

the gate further having top and bottom wood-plastic composite rails;

the top composite rail of the gate primarily made from a wood-plastic composite material; the top wood-plastic composite rail of the gate having an outer perimeter in cross section;

an upper mount mounted against the inwardly-facing outer surface of each side rail with fasteners that extend through the lower mount and the inwardly-facing outer surface; each of the upper mounts having a portion disposed within the outer perimeter of the top wood-plastic composite rail of the gate;

the bottom wood-plastic composite rail primarily made from a wood-plastic composite material; the bottom wood-plastic composite rail having an outer perimeter in cross section;

a lower mount mounted against the inwardly-facing outer surface of each side rail with fasteners that extend through the lower mount and the inwardly-facing outer surface; each of the lower mounts having a portion disposed within the outer perimeter of the bottom wood-plastic composite rail of the gate;

the upper and lower mounts being L-shaped and including first and second legs; the first legs of each mount being disposed against the inwardly-facing outer surface of the side rail to which it is attached; and the top wood-plastic composite rail of the gate has the same cross sectional size and shape as the top composite rail of the railing section and the bottom wood-plastic composite rail of the gate has the same cross sectional size and shape as the bottom composite rail of the railing section.

17. The gate and railing section of claim 16, wherein the top wood-plastic composite rail includes a wood-plastic outer portion and a wood-plastic support portion that fit together to form the top wood-plastic composite rail.

18. The gate and railing section of claim 17, wherein the portion of the upper mount disposed within the outer perimeter of the top wood-plastic composite rail is disposed between the wood-plastic support portion and the wood-plastic outer portion.

19. The gate and railing section of claim 17, wherein the portion of the upper mount disposed within the outer perimeter of the top wood-plastic composite rail is disposed under the wood-plastic support portion of the top rail.

20. The gate and railing section of claim 19, further comprising a fastener that extends through the upper mount, the wood-plastic support portion, and into the wood-plastic outer portion.

* * * * *